US008232489B2

(12) United States Patent
Frassineti et al.

(10) Patent No.: US 8,232,489 B2
(45) Date of Patent: Jul. 31, 2012

(54) SWITCHING DEVICE INSTALLABLE ACCORDING TO DIFFERENT OPERATING CONFIGURATIONS

(75) Inventors: Giovanni Frassineti, Bergamo (IT); Federico Gamba, Bergamo (IT)

(73) Assignee: ABB S.p.A., Milano (IT)

( * ) Notice: Subject to any disclaimer, the term of this patent is extended or adjusted under 35 U.S.C. 154(b) by 285 days.

(21) Appl. No.: 12/598,604

(22) PCT Filed: May 2, 2008

(86) PCT No.: PCT/EP2008/055434

§ 371 (c)(1),
(2), (4) Date: Mar. 8, 2010

(87) PCT Pub. No.: WO2008/135534

PCT Pub. Date: Nov. 13, 2008

(65) Prior Publication Data

US 2010/0163377 A1 Jul. 1, 2010

(30) Foreign Application Priority Data

May 4, 2007 (IT) ..... BG2007A0026

(51) Int. Cl.
*H01H 9/18* (2006.01)
*H01H 9/20* (2006.01)

(52) U.S. Cl. ..... 200/50.21; 200/50.23; 200/50.26; 200/308; 200/310; 361/605

(58) Field of Classification Search ..... 361/600–602, 361/605, 606, 608, 614, 622, 627, 628, 631, 361/641, 643–645; 200/50.21, 50.23, 50.26, 200/17 R, 18, 400, 401, 293, 308, 310
See application file for complete search history.

(56) References Cited

U.S. PATENT DOCUMENTS 5,575,381 A * 11/1996 Castonguay et al. ..... 200/401
(Continued)

FOREIGN PATENT DOCUMENTS

EP 1600993 11/2005
(Continued)

OTHER PUBLICATIONS

Unknown:"Color LCD-Bedieneinhit ink Touch-Panel" [Online], Feb. 5, 2004, Electronic Assembly GmbH, XP002486904 Retrieved from the Internet: URL:http://www.lcd-module.de/deu/pdf/grafik/kit320f-8.pdf> {retrieved on Jul. 4, 2008}.

*Primary Examiner* — Michael Friedhofer
(74) *Attorney, Agent, or Firm* — Paul R. Katterle; Melissa J. Szczepanik

(57) ABSTRACT

A switching device, in particular an automatic switch, a disconnecting switch or a contactor, installable according to different operating configurations and preferably for use in low voltage systems. The device comprises a case containing at least a pair of contacts, one or more accessory devices for controlling and/or setting the operation of the switching device and user interface means, capable of performing output and/or input functions relative to the accessory devices. These interface means comprise at least a display which shows information relative to the output and/or input functions according to a viewing direction. The switching device also comprises means to select the viewing direction which are operatively connected to the display. These selection means allow selection of the viewing direction on the display as a function of the installation configuration of the switching device.

20 Claims, 12 Drawing Sheets

U.S. PATENT DOCUMENTS

| | | | | |
|---|---|---|---|---|
| 5,771,207 | A * | 6/1998 | Muroi et al. | 368/10 |
| 5,949,640 | A * | 9/1999 | Cameron et al. | 361/600 |
| 6,140,579 | A * | 10/2000 | Niedermann et al. | 174/561 |
| 6,304,919 | B1 * | 10/2001 | Louis et al. | 710/1 |
| 7,095,302 | B2 * | 8/2006 | Puskar et al. | 335/17 |
| 7,612,988 | B2 * | 11/2009 | Ulinskas | 361/614 |
| 2007/0008345 | A1 * | 1/2007 | McDonald et al. | 345/659 |
| 2007/0111750 | A1 * | 5/2007 | Stohr et al. | 455/550.1 |
| 2007/0158442 | A1 * | 7/2007 | Chapman et al. | 236/1 C |
| 2008/0016452 | A1 * | 1/2008 | Pincus | 715/763 |

FOREIGN PATENT DOCUMENTS

| | | |
|---|---|---|
| WO | 99/63636 | 9/1999 |
| WO | 2006/120142 | 11/2006 |
| WO | PCT/EP2008/055434 | 7/2008 |
| WO | 2008/135534 | 11/2008 |

* cited by examiner

SWITCHING DEVICE INSTALLABLE ACCORDING TO DIFFERENT OPERATING CONFIGURATIONS

The present invention relates to a switching device, in particular to an automatic switch, a disconnecting switch or a contactor, installable according to different operating configurations and preferably for use in low voltage electrical systems.

It is known that switching devices (such as automatic switches, disconnecting switches and contactors), hereinafter called switches for brevity, comprise one or more electrical poles, associated with each of which is at least a fixed contact and at least a moving contact that can be reciprocally connected to/disconnected from each other. Prior art switches also comprise control means that allow the moving contacts to be moved thereby causing connection to or disconnection from the relative fixed contacts.

Prior art switches normally comprise accessory devices such as protection devices (relays), trip devices (trip relays), thermal sensors, magnetic sensors, voltammetric sensors and/or amperometric sensors, for which relative user interface means are provided to allow, for example, setting of the calibration and/or operating conditions and/or reading of data and information concerning operation. These interface means can comprise means for viewing information relative to the functions performed, such as displays. These displays are normally installed on the front side of the switch, and in turn exist in many different forms and perform output and/or input functions.

It is also known that switches are normally installed in switchboards, which comprise electrodes or busbars that by preference extend in a vertical or horizontal direction. According to whether the busbars extend vertically or horizontally, it is desirable for switches to be installable according to a configuration that is either vertical or horizontal.

From a practical viewpoint it is known that almost all MCCB (molded case circuit breakers) are designed to be installed according to either of these configurations. However, a recent solution, described in the patent application WO2006120142, also introduces for devices of superior size, such as ACB (Air Circuit Breakers), the possibility of installation either in a vertical or horizontal configuration.

The various accessory devices are as a rule mounted on the switch so that the relative display is available to the operator for output and/or input functions on the front side of the switch. In the most common cases, there is only one way of mounting the relative display. Consequently, once the accessory device has been installed a privileged condition is established in relation to the user, which usually corresponds to the switch being installed in a vertical configuration. Clearly, by installing a switch in a horizontal configuration the various messages and instructions on the display, and in general all the output and/or input functions, continue to be available, but according to a vertical viewing direction, with a position from top to bottom or vice versa.

A similar problem occurs for switch/accessory device combinations in which the output and/or input functions from the display are such as to privilege installation of the switch in a horizontal configuration, as in fact in this case use in a vertical configuration would be disadvantageous.

This means that, at the current state of the art, a switch that, for example, privileges vertical configuration causes unavoidable drawbacks in the output and/or input functions when the switch is installed according to a different configuration, for example horizontal.

Some switches of recent conception (such as those described in the patent application EP1600993A1), have introduced the possibility of installing the accessory display devices according to different angles (horizontal or vertical), allowing the user to choose the correct viewing direction of the output and/or input functions by modifying the angle of installation of the display. However, the drawback of requiring to perform manual hardware operations remains, making solutions of this type costly and not without risks for correct operation of the system. The most evident risks relative to manual operations on the switch/accessory device system can be summed up as follows: possibility of interfering with the functions of the display cables; possibility of imperfect installation of the display and possible decline of the IP protection rating; high costs due to the large number of moving parts and coupling and sealing means; possible wear and deterioration of parts subject to movement; etc.

Therefore, there is the need to provide switching devices in which the use of user interface means and output and/or input functions is not privileged according to the horizontal or vertical installation configuration of the device and which do not require operations or actions on the hardware.

On the basis of these considerations, the main aim of the present invention is to provide a switching device that allows the aforesaid limits and drawbacks to be overcome.

Within the scope of this aim, an object of the present invention is to provide a switching device installable according to different configurations (at least horizontal and vertical), which is provided with user interface means that allow relatively simple performance of the output and/or input functions relative to accessory devices of this switching device.

Another object of the present invention is to provide a switching device installable according to different configurations, which is provided with functionally versatile interface means in relation to the different possible installation configurations without requiring operations on the hardware that are risky for the reliability and useful life of these interface means.

A further object of the present invention is to provide a switching device installable according to different configurations, which is provided with user interface means composed of a relatively small number of easily assemblable and functionally reliable elements.

Yet another object of the present invention is to provide a switching device installable according to different configurations, which is highly reliable and relatively easy to produce at competitive costs.

This aim, and these and other objects that will be more apparent below, are achieved through a single-pole or multipole switching device for low voltage electrical circuits comprising:

- a case containing at least a pair of contacts activatable between a first connection position and a second separation position;
- one or more accessory devices for controlling and/or setting operation of the switching device, and user interface means capable of performing output and/or input functions relative to said one or more accessory devices. These interface means comprise at least a display, preferably positioned in a fixed position on the case, which shows information relative to the output and/or input functions according to a viewing direction.

The switching device according to the invention is characterized by the fact that it comprises means to select the viewing direction operatively connected to said display; these selection means allow selection of the viewing direction of the display.

The use of selection means advantageously allows selection of the viewing direction most suitable for the user to position the interface means of the switching device and in particular of the display. In other words, these means allow selection of the most convenient viewing direction, at least for reading the display. It is observed that, unlike conventional switching devices, this is attained separately from the installation position of the display on the case of the device, or in other words, without modifying the physical orientation thereof.

The means for selecting the viewing direction can be managed without distinction in manual mode directly by the user (for example, through selection push buttons, micro dip switches, input signals coming from the display, if it is of the touch screen type, or through external devices, for example of the wireless type); or automatically, for example through gravitational sensors of the installation configuration (intended as angular position of the switching device).

Further characteristics and advantages of the invention will be more apparent from the description of preferred, but not exclusive, embodiments of the switching device according to the invention shown by way of non-limiting example in the accompanying drawings, wherein.

Figure 1:
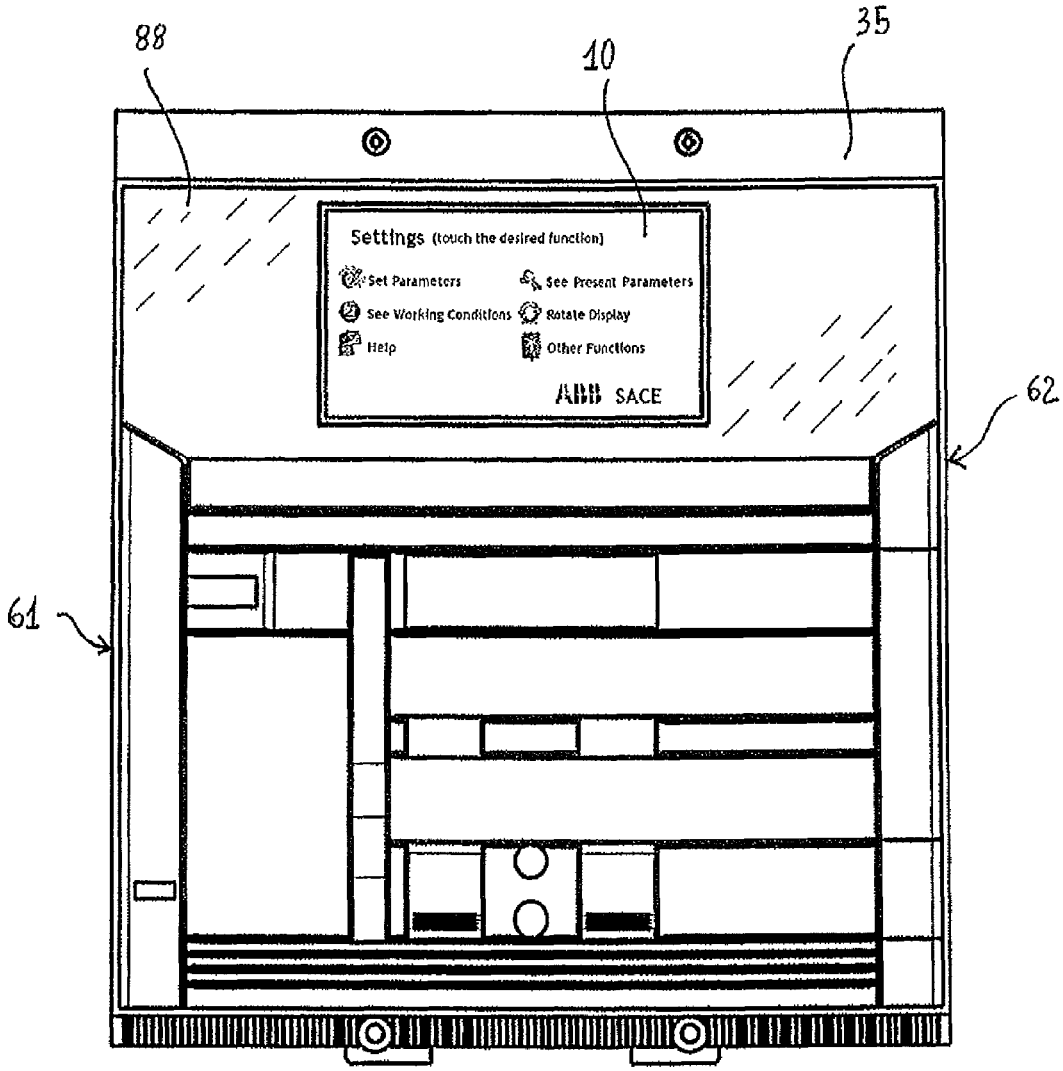
FIG. 1 is a front view of a switching device according to the invention.

With reference to the aforesaid figures, the switching device 1 according to the present invention comprises a case containing at least a pair of contacts activatable between at least a first connection position in which the contacts are connected and the circuit is closed and a second separation position in which the contacts are separated and the circuit is open. The switching device 1 comprises one or more accessory devices 6 for controlling and/or setting operation which can, for example, be protection relays, thermal, magnetic, voltammetric and/or amperometric sensors. In general, the expression "accessory device" 6 indicates any device that can be integrated in the switching device 1 for the purpose of controlling, setting and correct operation of this device, or also of providing it with additional functions.

The switching device 1 also comprises user interface means 5 which perform output and/or input functions relative to the accessory devices 6. The expression "output functions" indicates in general those functions that allow exchange of information from the accessory devices 6 to the user, while input functions indicates those functions that allow an exchange of information in the opposite direction, i.e. from the user to the accessory devices 6. In particular, the input functions allow the user to set, for example, the operating parameters of the accessory devices 6, in other words to configure the various settings of these devices. The interface means 5 comprise at least a display 10 to view information relative to the output and/or input functions according to a viewing direction and position indicated in the figures by the arrow with the reference 100. The display 10 is preferably installed in a fixed position on said case.

The switching device 1 according to the invention is characterized in that it comprises means 20 to select the viewing direction and position 100 operatively connected to the display 10. In particular, these selection means 20 allow selection of the viewing direction and position 100 on the display 10 as a function of the installation configuration of the switching device 1. In other words, the selection means 20 allow the user to vary the viewing direction or position 100 so as to determine the one most suitable for the user in relation to the installation configuration of the switching device 1. This variation of the viewing direction has direct effect on the display 10, without varying the position thereof with respect to the case.

In this regard and as will be explained in greater detail below, the selection means 20 can be operated manually or can be operated automatically comprising, for example, sensor means. In the first case, selection of the viewing direction is determined directly by the user by means of manually operated selectors (e.g. hardware components such as push buttons or dip switches, or alternatively wireless components). In the second case, selection is determined automatically by sensor means (e.g. of gravitational or limit switch type), which recognize the installation configuration of the switching device 1 and supply the display 10, by means of the control unit 50 thereof, described below, with the correct viewing direction 100.

Figure 2A:
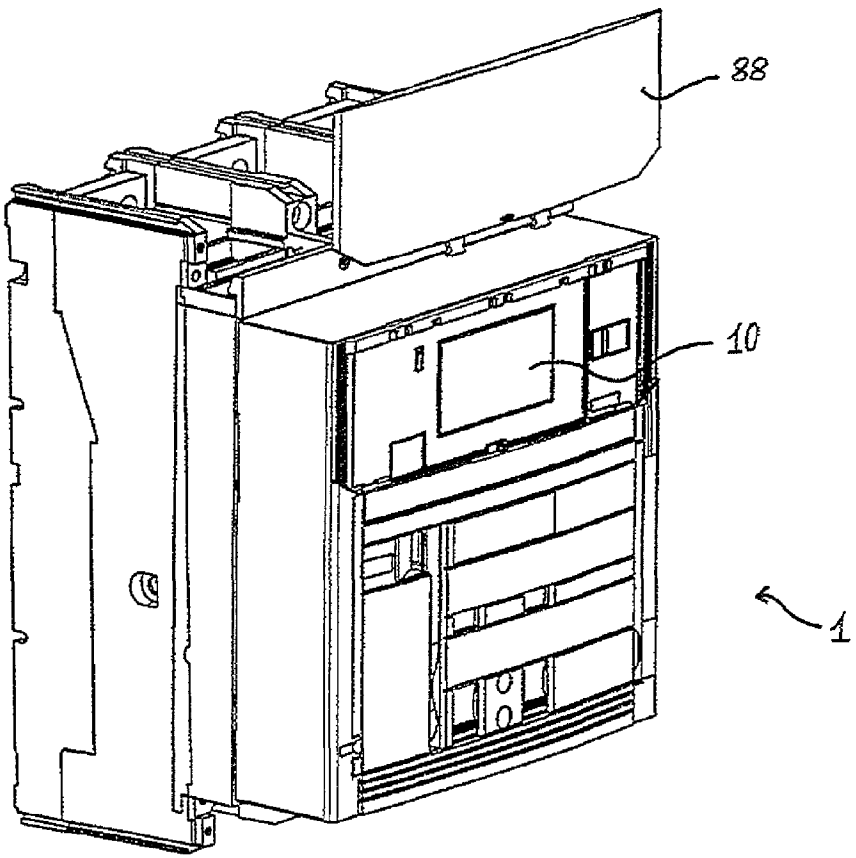
FIGS. 2 and 2A are respectively a front view and a perspective view of a switching device according to the invention provided with a removable protective cover for the display.
Figure 2:
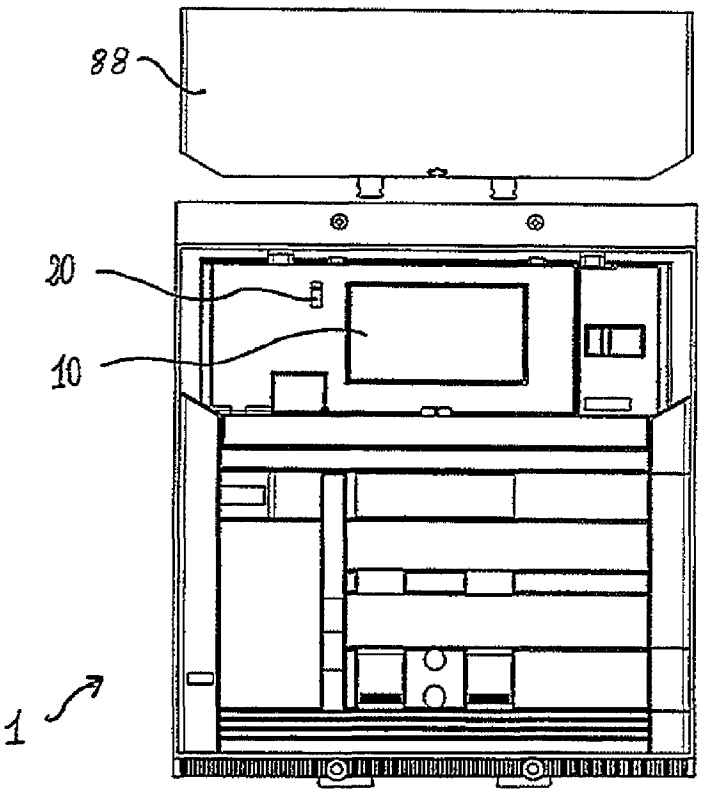

FIG. 1 shows a possible embodiment of a switching device 1, according to the present invention. As shown, the display 10 is disposed on the front side 35 of the case. The display 10 can be of any available type, e.g. black and white with integrated controller (see FIG. 4), or of the TFT type without controller. In the same way, the shape of the display 10 can be totally variable, starting from the rectangular one shown in FIG. 1. With reference to FIGS. 2 and 2A, the switching device 1 preferably comprises a protective cover 88, which is fastened removably to the case so that it is placed in front of the display 10.

Figure 3:
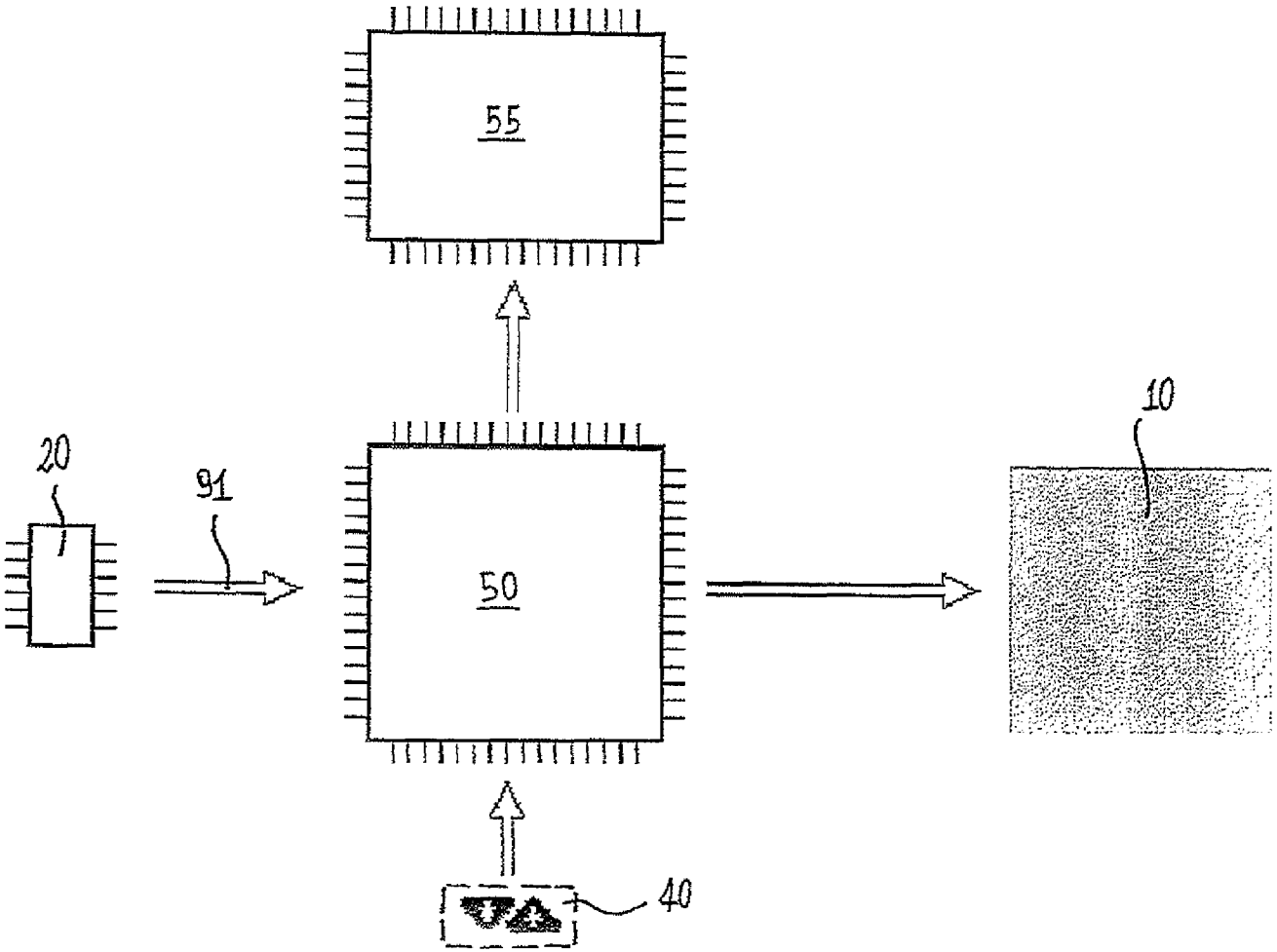
FIGS. 3 and 4 are two block diagrams relative to possible embodiments of user interface means of a switching device according to the invention.
Figure 4:
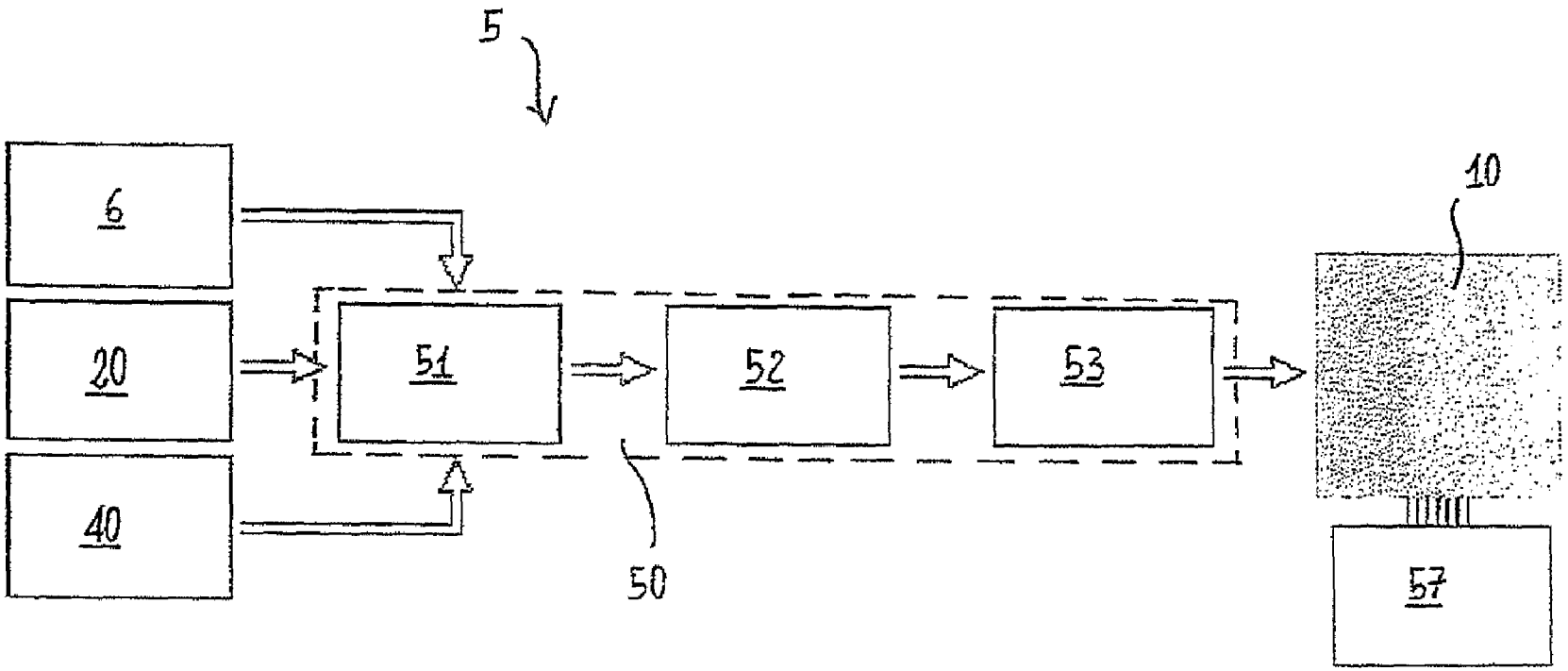

With reference in particular to the block diagrams of FIGS. 3 and 4, the interface means 5 comprise a control unit 50 of the display 10 to which the selection means 20 and the accessory devices 6 are operatively connected. The control unit 50 is preferably composed of at least a micro-controller, provided with a suitable memory 55. The micro-controller defines the viewing direction 100 on the display 10 as a function of a selection signal 91, which is generated by the selection means 20. At the same time, the micro-controller defines the content of the page or screen that is viewed on the display 10 on the basis of the output/input functions relative to the accessory devices 6.

With reference to the schematic view of FIG. 4, according to a preferred embodiment of the invention, the interface means 5 comprise input means 40, which allow the aforesaid input functions to be performed. These input means 40 are preferably integrated with the display 10 according to known touch screen operation modes. Alternatively, the input means 40 could be composed of one or more hardware components such as a push button panel or keypad located in proximity of the display 10. In another alternative, the input means could comprise a remote control or any available wireless communication system.

As mentioned above, the control unit 50 of the display 10 in practice has the function of processing each single page to be viewed on the display according to any known electronic page layout method. For this purpose, the control unit 50 comprises a first computerized unit 51 which has the function of "building" the page to be viewed as a function of the signals sent by the selection means 20, by the keypad means 40 and by the signals sent/exchanged with the accessory devices 6. In particular, this page is built through page descriptors which, by means of a second computerized unit 52 connected to the first unit 51, generate a relative image. A third computerized unit 53 is instead in charge of transferring the image built by the second unit 52 to the display 10. In other words, the third unit 53 forms the physical interface between the control unit 50 and the display 10 adapting information objects, such as alphanumeric characters and graphic symbols, to the physical characteristics of the display 10.

The interface permitted by this third computerized unit 53 is a function of the characteristics of the display 10, such as colors, B/W, number of pixels per side, presence or absence of an integrated controller. For example, if a black and white display with integrated controller 57 with an array of pixels is used, the task of the third display unit 53 is to supply the controller 57 with the pixels to be viewed, according to a relative protocol required thereby (e.g. serial or parallel). In this condition, assuming that the controller 57 is organized in lines and columns, the data processed by the first computerized unit 51 are adapted to the technical requirements of the third computerized unit 53 through the second unit 52. Instead, if a TFT display without controller is used, the task of the third computerized unit is to supply the controller with the pixels to be viewed through a protocol, for example, of RGB triples.

Figure 5:
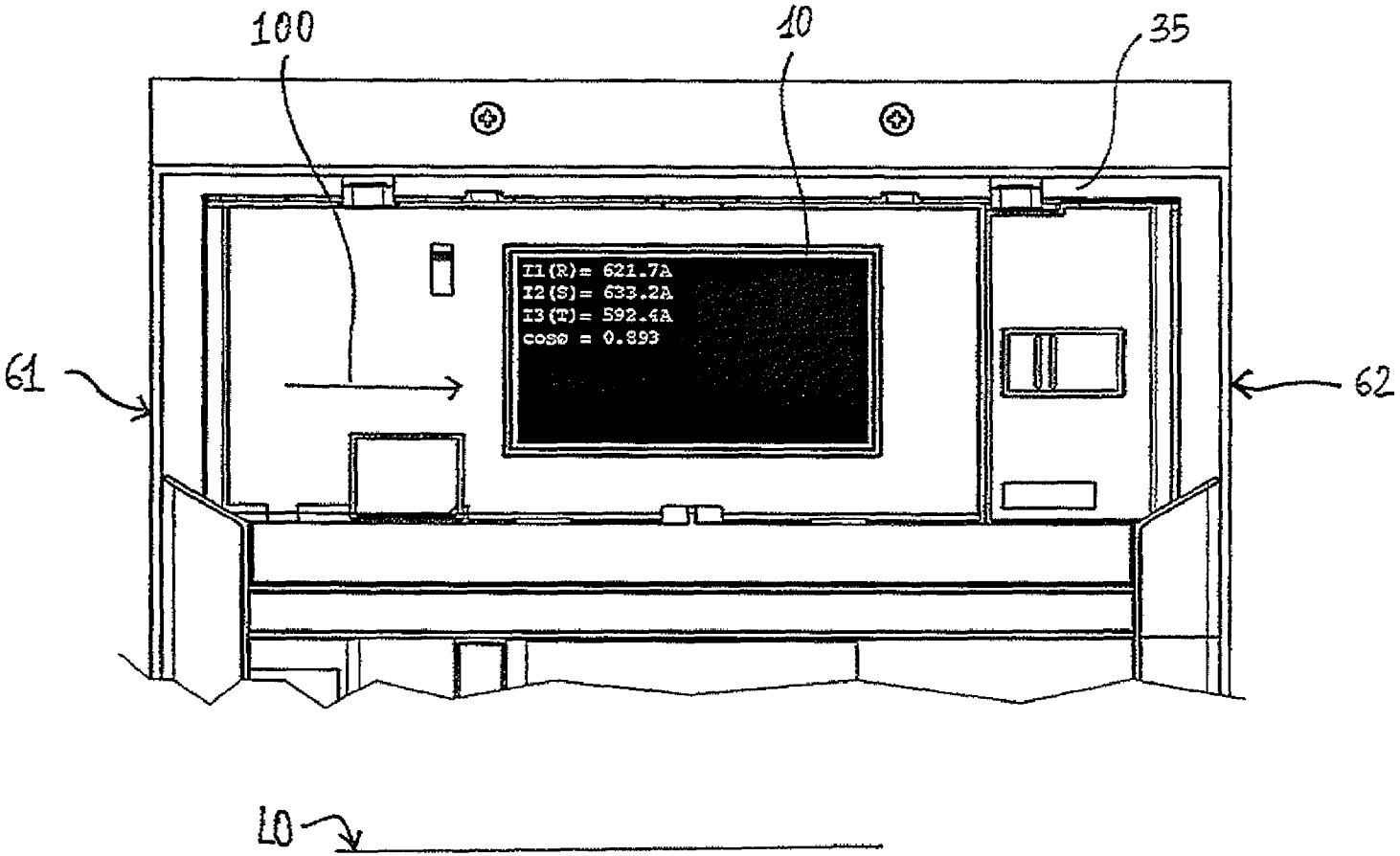
FIG. 5 is a view of a switching device according to the invention installed vertically with respect to a horizontal reference plane (plane LO)

In FIG. 5 a switching device 1 is shown according to a vertical installation configuration evaluated with respect to a reference plane LO. As is evident, the display 10 shows a plurality of lines of information according to a direction 100 substantially parallel to the reference plane LO.

Figure 6:
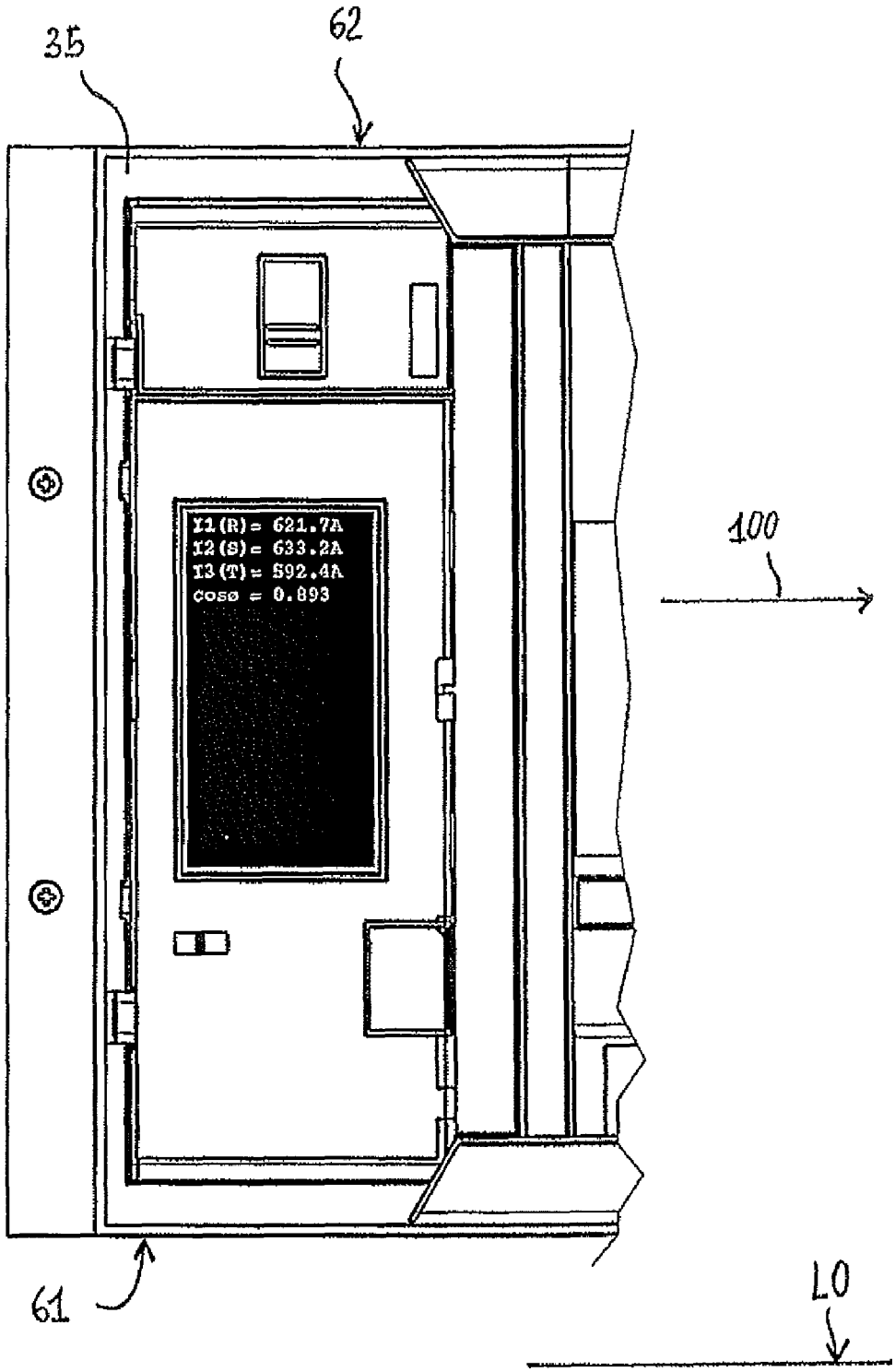
FIGS. 6 and 7 are views of the device of FIG. 5 installed horizontally with respect to a horizontal reference plane (plane LO) respectively according to a first and a second lateral side of the switching device.

FIG. 6 shows the device of FIG. 5 installed according to a different installation configuration, more specifically horizontal, so that a first side 61 is used as supporting surface for installation and is substantially parallel to the horizontal reference plane LO. As is evident, selection means 20 allow a viewing direction 100 substantially parallel to the reference plane LO to be maintained. As can be observed, this condition is reached without any modification of the physical position of the display 10 on the case. In other words, the viewing direction 100 is varied directly on the display 10, which maintains the same installation configuration on the case.

Figure 7:
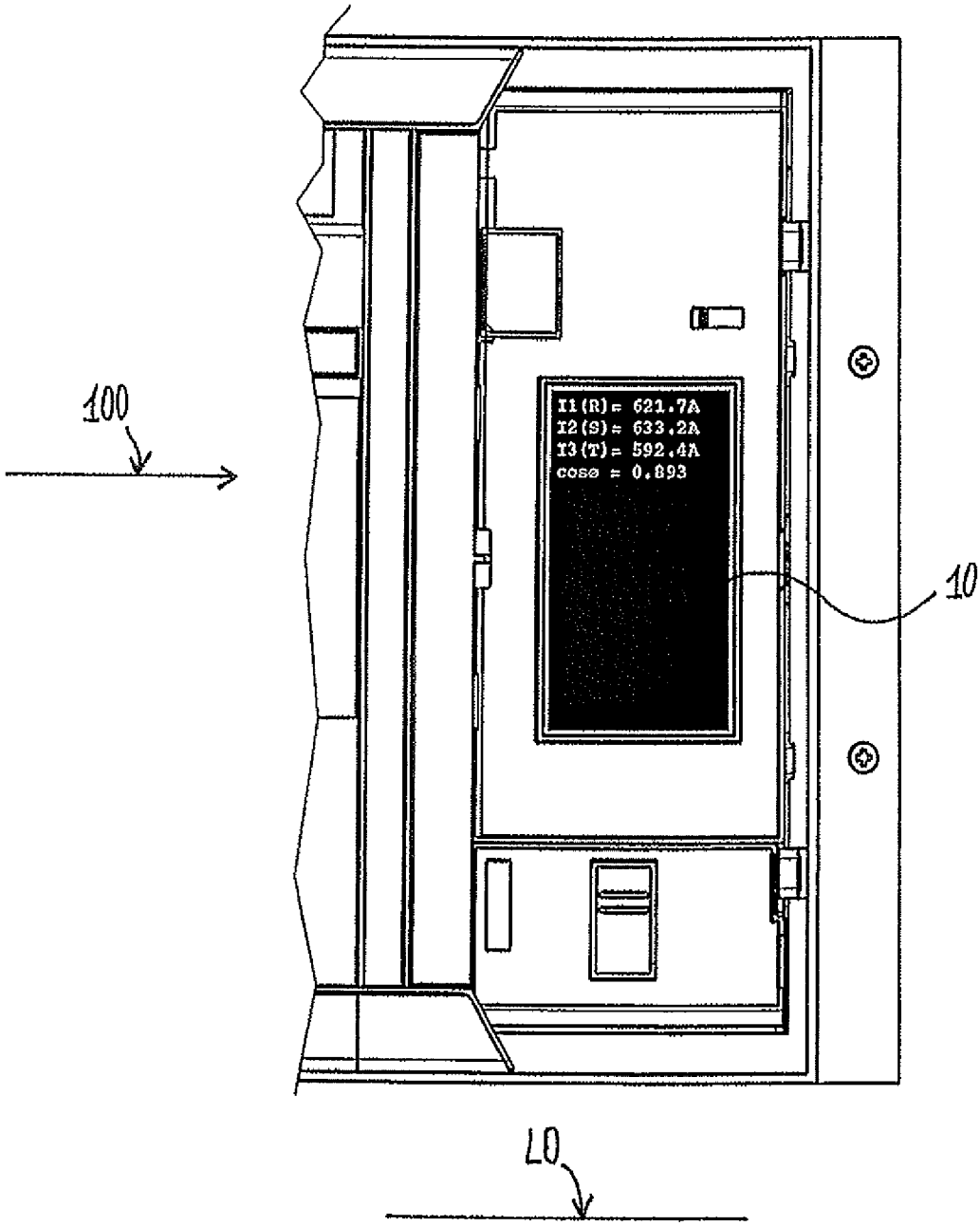

FIG. 7 shows the switching device of FIG. 5 again according to a horizontal installation configuration, but in the opposite position to the one shown in FIG. 6, i.e. so that a second side 62, opposite the first side 61, is used as supporting surface for installation, it be parallel to the horizontal reference plane LO. As can be observed, in the configuration of FIG. 7, through use of the selection means 20, the image viewed on the display 10 is for the observer coincident with the one in FIG. 6, although the installation configuration of the switching device 1 is opposite.

Figure 8:
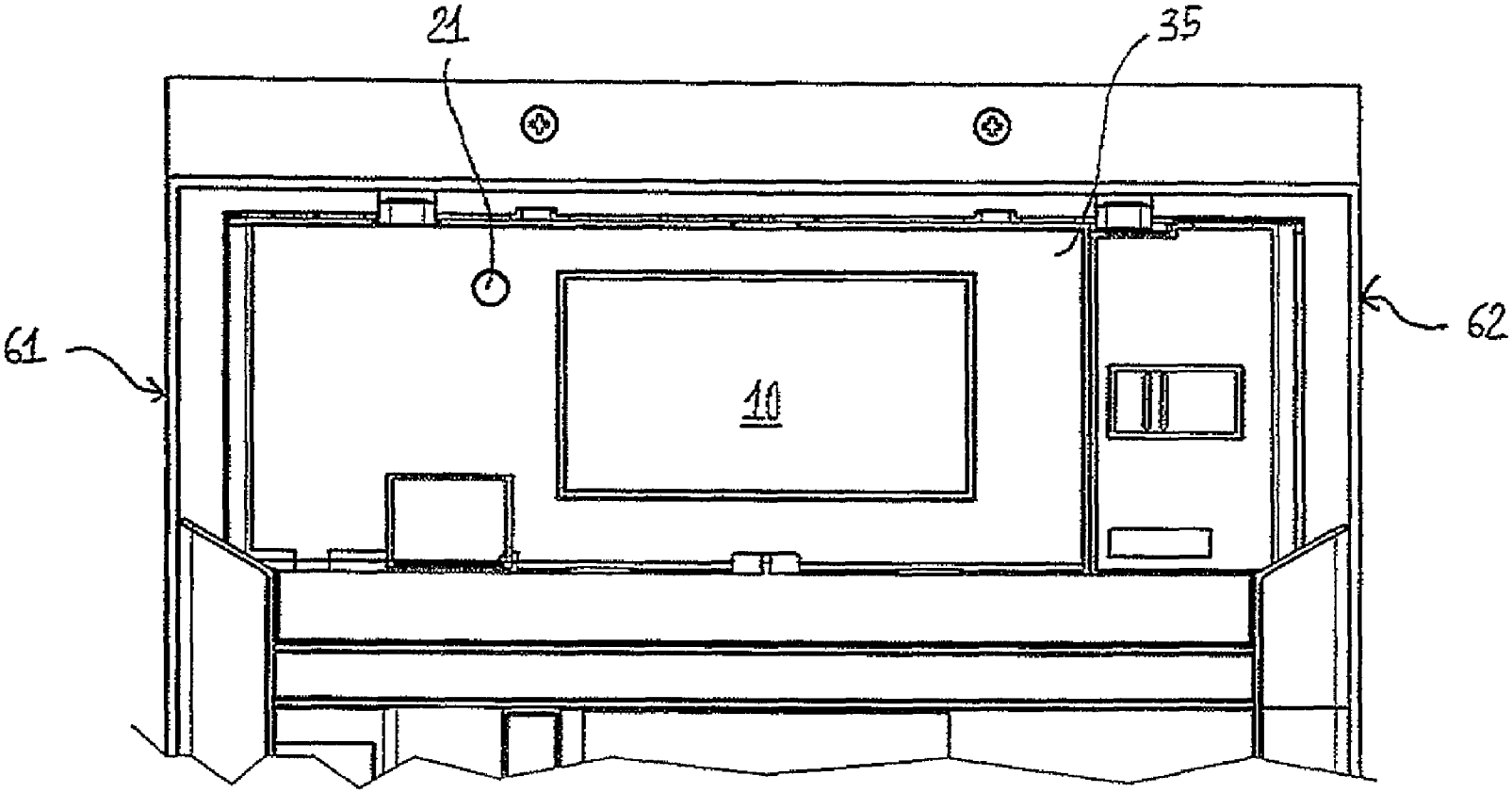
FIG. 8 is a view of a switching device according to the present invention which shows a first possible form of the selection means.
Figure 9:
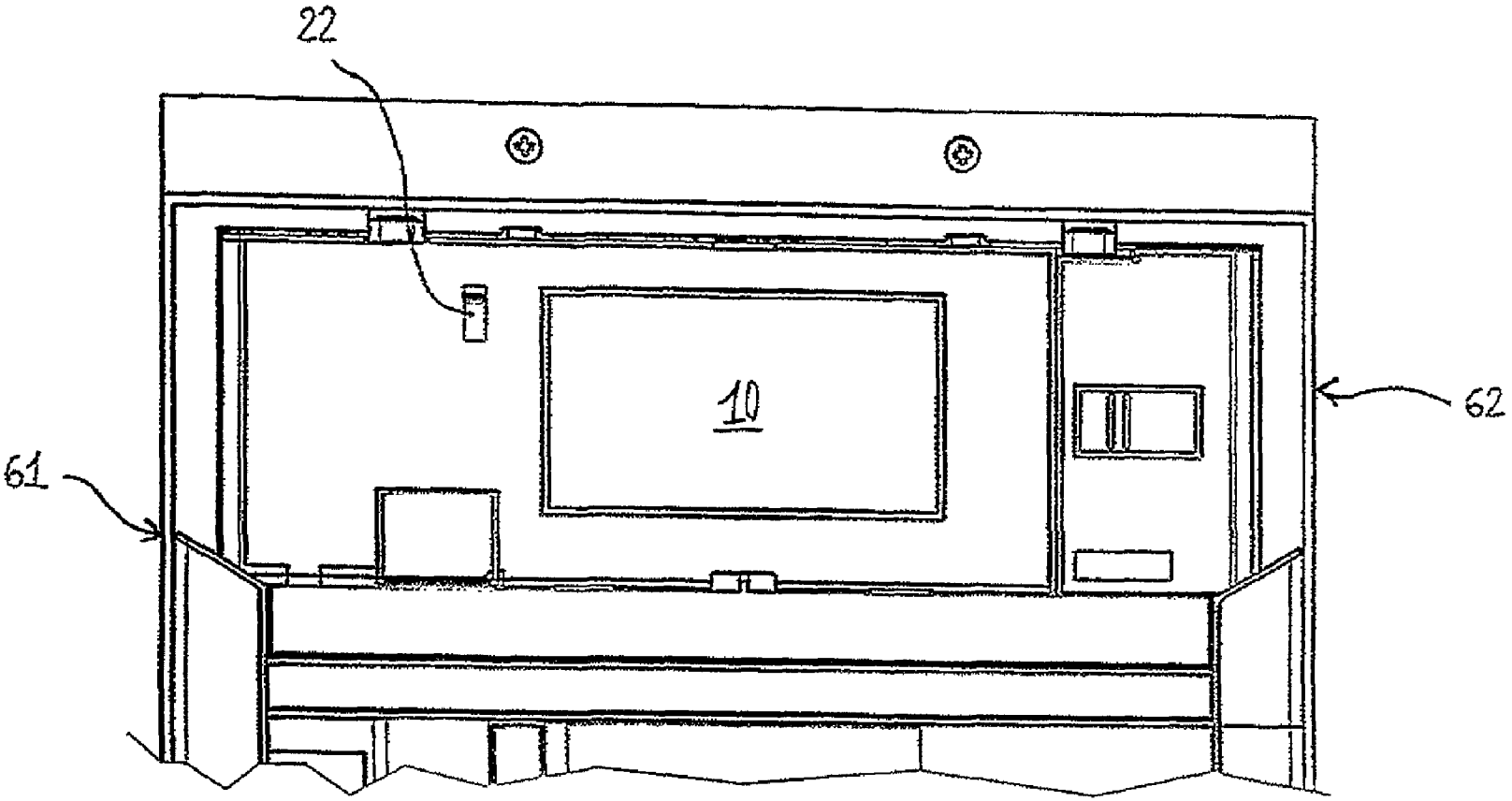
FIG. 9 is a view of a switching device according to the present invention which shows a second possible form of the selection means.
Figure 10:
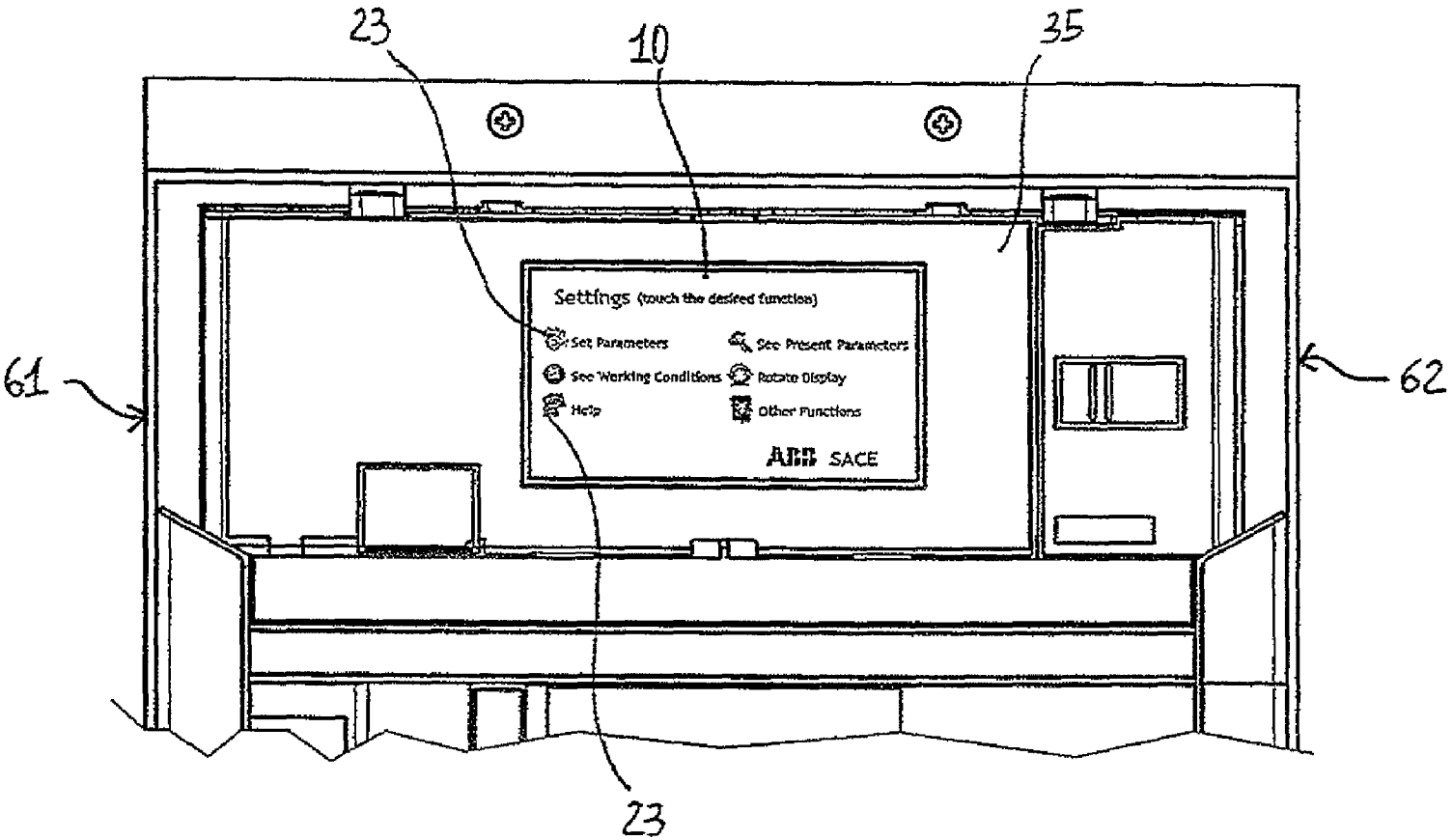
FIGS. 10 and 11 are two views, according to two different installation configurations, of a switching device according to the present invention and show a third possible form of the selection means of this device.

As mentioned above, the selection means 20 can be operated manually or alternatively can be replaced by sensor means which automatically generate a selection signal 91 as a function of which the control unit 50 determines the most suitable viewing direction. FIGS. 8 and 9 show possible manually operated selection means 20. In more detail, in FIG. 8 the selection means 20 comprise a selection push button 21 which, when activated by a user, generates a selection signal 91, for example a pulsed signal. According to a possible operating mode, following said selection signal 91, the control unit 50 determines on the display 10 a variation in the viewing direction 100 of an angle typically equal to 90 degrees. In other words, each time the selection push button 21 is activated, the image that appears on the display 10 rotates through 90 degrees.

In the embodiment shown in FIG. 9, the selection means 20 instead comprise at least a component 22 of the dip-switch type. As is known, this component is formed of a group of switches packaged in a single container. Once activated by a user, these switches generate one or more selection signals 91 intended for the control unit 50 of the display 10.

Figure 11:
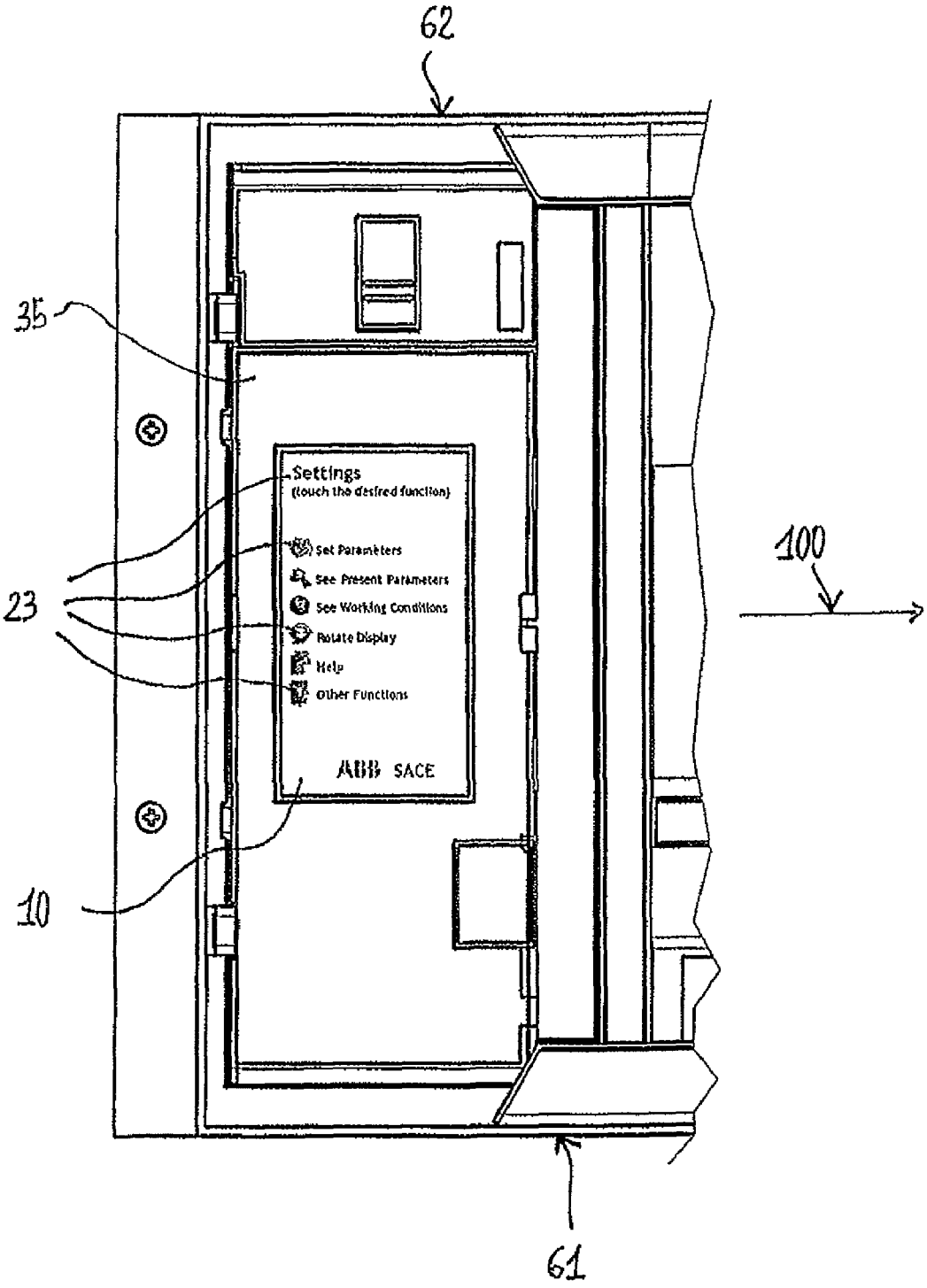
Figure 12:
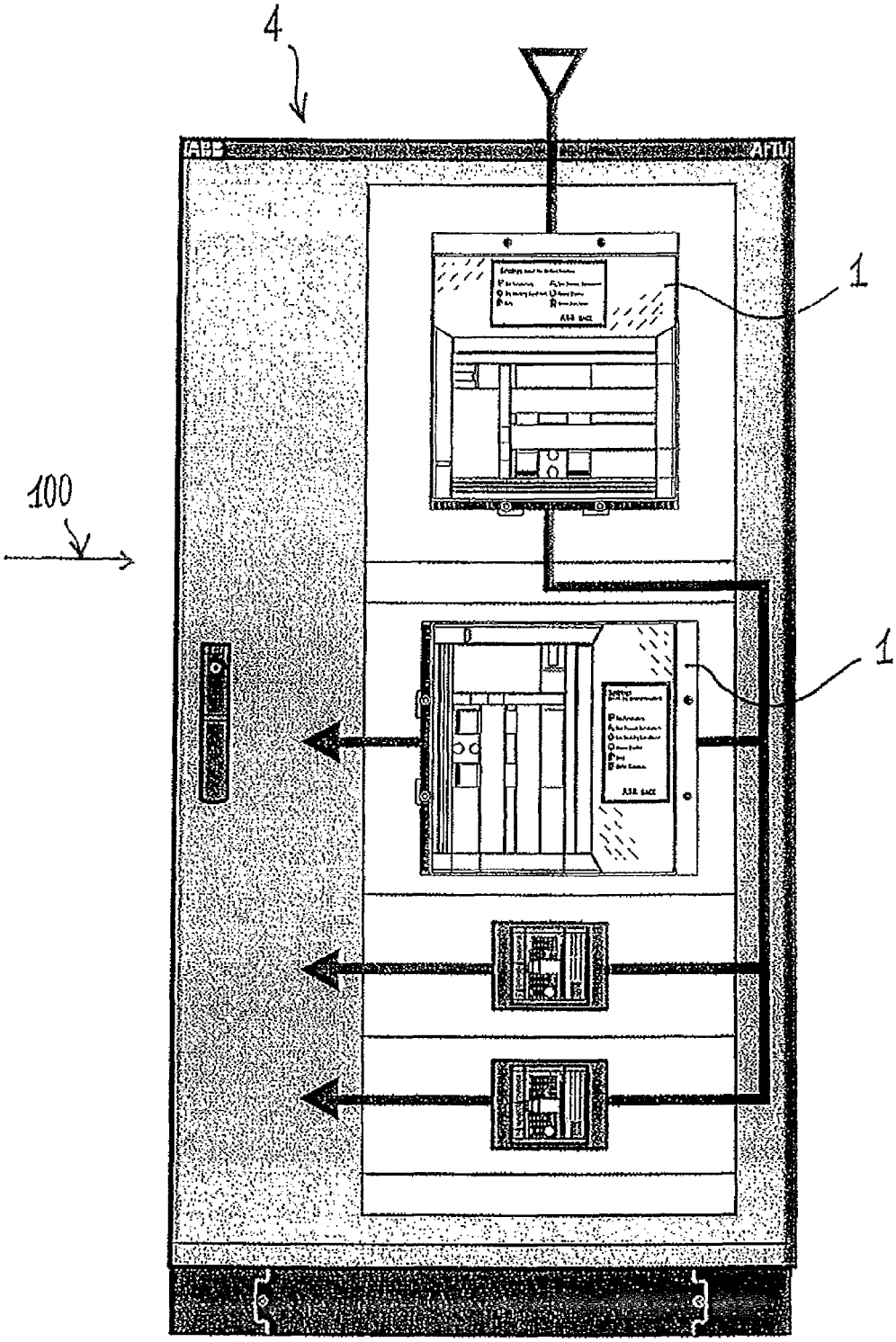
FIG. 12 is a view of a switchboard provided with two switching devices according to the present invention installed according to two different configurations.

In the further embodiment shown in FIGS. 11 and 12, the selection means 20 comprise one or more selection icons 23 viewed on the display 10 according to touch screen operation modes. This solution is extremely advantageous, as it allows elimination of the components provided in the two previous solutions, simplifying the configuration of the case and, more generally, of the switching device 1.

As mentioned above, the manually operated selection means could be replace by sensor means, for example gravitational sensors or limit switch sensors operatively connected to the control unit 50 to generate, automatically, a selection signal 91 characteristic of the orientation of the display 10 (or alternatively of the case). In other words, these sensor means identify the installation configuration of the switching device 1 recognizing the orientation in space of the display 10 or alternatively of the switching device 1, which is typically integral therewith.

FIG. 12 is a view of a switchboard 4 characterized in that it comprises a first and a second switching device according to the present invention and installed according to different configurations. As shown, regardless of the different installation configurations, the screens of the respective displays of the switching devices are advantageously viewed according to a same direction by virtue of the use of selection means according to the present invention.

The technical solutions adopted for the switching device allow the aims and objects set to be fully achieved. In particular, the use of selection means allows selection of the most suitable viewing direction for the installation configuration chosen for the switching device. This selection takes place without varying the orientation of the display in relation to the case, with obvious advantages both from the practical viewpoint and from that of operating reliability. The switching device thus conceived is susceptible to numerous modifications and variants, all falling within the inventive concept; moreover all details can be composed of other technically equivalent details.

In practice, the materials used and the contingent dimensions and forms can be any, according to requirements and to the state of the art.

The invention claimed is:

1. A switching device for low voltage electrical circuits, comprising:

a case containing at least a pair of contacts which can be actuated at least between a first connection position and a second separation position;

one or more accessory devices for controlling and/or setting operation of said switching device;

user interface means capable of performing output and/or input functions relative to said one or more accessory devices, said interface means comprising at least a display positioned on said case, said display showing information relative to said output and/or input functions according to a viewing direction, said interface means comprising a control unit of said display operatively connected to said one or more accessory devices; and wherein said interface comprises means to select said viewing direction operatively connected to said display and to said control unit, said selection means allowing selection of said viewing direction on said display as a function of the installation configuration of said switching device, said control unit defining said viewing direction on said display and building the page to be viewed in said display as a function of a selection signal generated by said selection means.

2. The switching device as claimed in claim 1, wherein said display is installed in a fixed position on said case.

3. The switching device as claimed in claim 1, wherein said user interface means comprise a control unit of said display operatively connected to said selection means.

4. The switching device as claimed in claim 3, wherein said interface means comprise input means operatively connected to said control unit.

5. The switching device as claimed in claim 4, wherein said input means are integrated with said display according to touch screen operation modes.

6. The switching device as claimed in claim 4, wherein said input means comprise one or more keypad hardware components.

7. The switching device as claimed in claim 3, wherein said control unit comprises one or more micro-controllers.

8. The switching device as claimed in claim 1, wherein said selection means are manually operated.

9. The switching device as claimed in claim 8, wherein said manually operated selection means are of the hardware type.

10. The switching device as claimed in claim 9, wherein said manually operated selection means comprise a selection push button.

11. The switching device as claimed in claim 9, wherein said manually operated selection means comprise a component of the dip-switch type.

12. The switching device as claimed in claim 8, wherein said manually operated selection means are integrated on said display according to touch screen operation modes.

13. The switching device as claimed in claim 3, wherein said control unit, following said selection signal generated by said selection means, determines on said display a variation of said viewing direction of an angle substantially of 90°.

14. The switching device as claimed in claim 3, wherein said selection means comprise sensor means operatively connected to said control unit, said sensor means automatically generating a selection signal characteristic of the orientation of said display or of said case with respect to a direction of reference, said control unit defining said viewing direction on said display as a function of said selection signal generated by said sensor means.

15. The switching device as claimed in claim 14, wherein said sensor means comprise a gravitational sensor.

16. The switching device as claimed in claim 14, wherein said sensor means comprise one or more limit switch sensors.

17. The switching device as claimed in claim 1, wherein said accessory device is a protection relay.

18. The switching device as claimed in claim 1 wherein said accessory device is a sensor chosen from a group composed of thermal, magnetic, pressure, voltammetric and amperometric sensors.

19. A switchboard for low voltage systems comprising one or more switching devices as claimed in claim 1.

20. A low voltage electrical system comprising one or more switching devices as claimed in claim 1.

* * * * *